United States Patent [19]

Emblem et al.

[11] 4,068,701

[45] Jan. 17, 1978

[54] REFRACTORY MATERIALS

[76] Inventors: Harold Garton Emblem; Richard Dudley Shaw, both of Cosmos House, Bromley Common, Bromley BR2 9TL, England

[21] Appl. No.: 763,147

[22] Filed: Jan. 27, 1977

[30] Foreign Application Priority Data

Jan. 30, 1976 United Kingdom ..... 3807/76

[51] Int. Cl.[2] ..... B22C 9/12; B22C 5/08

[52] U.S. Cl. ..... 164/16; 164/20; 164/41

[58] Field of Search ..... 164/16, 19, 20, 21, 164/22, 41

[56] References Cited

U.S. PATENT DOCUMENTS

| | | | |
|---|---|---|---|
| 3,008,205 | 11/1961 | Blaies, Jr. | 164/16 |
| 3,209,421 | 10/1965 | Shepherd | 164/16 |
| 3,232,771 | 2/1966 | Pearce | 106/38.35 |
| 3,506,057 | 4/1970 | Pennock et al. | 164/19 |
| 3,607,319 | 9/1971 | Scott | 106/38.35 |
| 3,683,995 | 8/1972 | Zifferer | 164/16 X |
| 3,854,961 | 12/1974 | Flosch | 164/20 X |
| 4,018,858 | 4/1977 | Walters et al. | 264/63 X |
| 4,025,350 | 5/1977 | Walters et al. | 164/12 X |

FOREIGN PATENT DOCUMENTS

| | | | |
|---|---|---|---|
| 1,280,493 | 10/1968 | Germany | 164/20 |
| 979,197 | 7/1965 | United Kingdom | 164/20 |

*Primary Examiner*—Ronald J. Shore
*Attorney, Agent, or Firm*—Christensen, O'Connor, Garrison & Havelka

[57] ABSTRACT

A refractory shape is molded on a pattern by pouring over the pattern a mixture of two slurries each of which is stable but which together react to gell. The mixture is formed by merging two slurry streams immediately above the pattern.

11 Claims, 1 Drawing Figure

REFRACTORY MATERIALS

Figure 1:
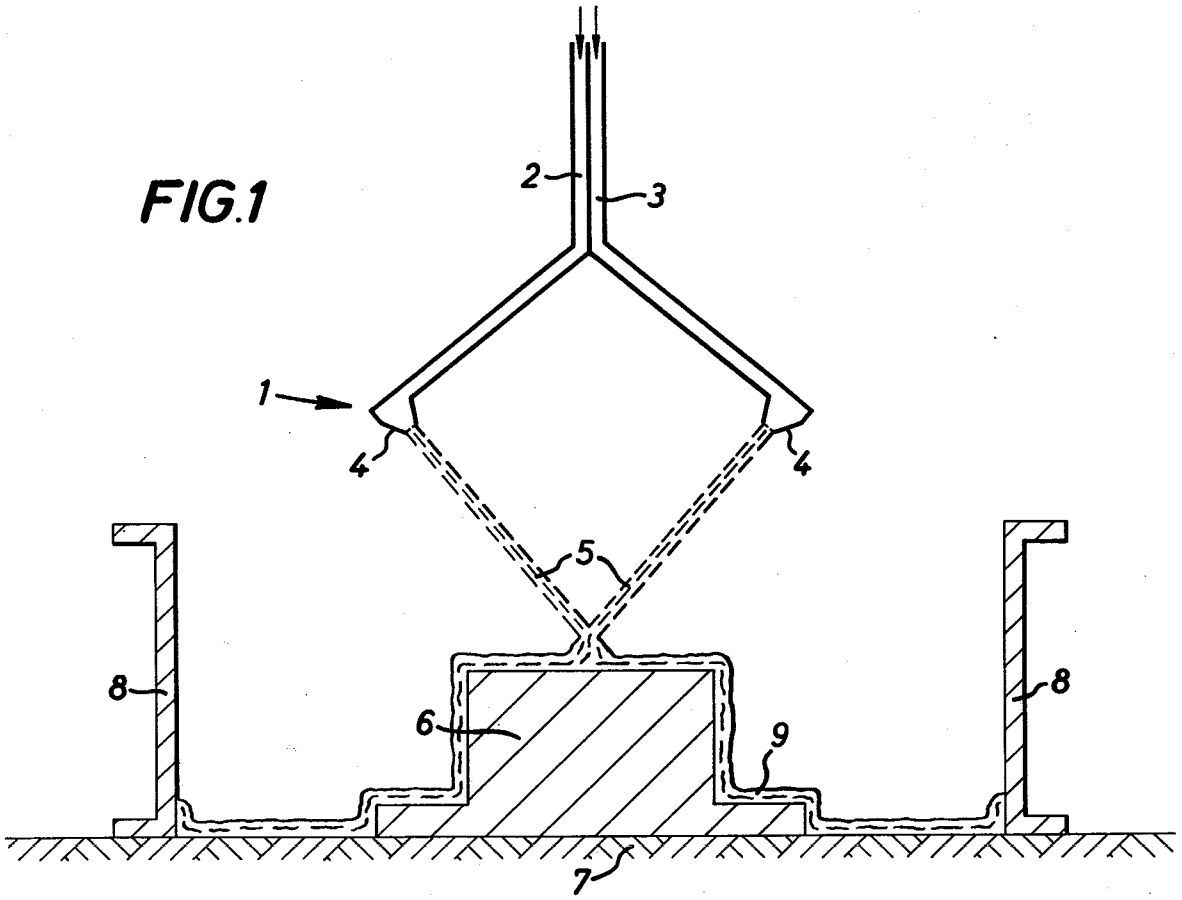

This invention relates to a method for the preparation of moulds and cores for the casting of liquids such as molten metals and/or alloys. When used with metals the invention is applicable to the casting of both ferrous and non-ferrous materials.

The present invention provides a method of preparing a mould or core for casting liquids such as molten metals, such method comprising the steps of coating a pattern with a mixture of two slurries each of which is substantially stable but which together gell to form a rigid coherent shape wherein each slurry is discharged as a stream onto the pattern, the two streams converging adjacent the pattern to mix the slurries.

The following systems are specifically envisaged:

a. The zirconium salt/magnesia dispersion systems of copending Patent Application Ser. No. 561,245 now U.S. Pat. No. 4,018,858 assigned to Zirconal Processes Limited. The preferred system includes in one slurry a zirconium salt and a gellation-delaying agent and in the other slurry the special magnesia dispersion.

b. The acidic zirconium salt/gellation-delaying agent/gellation-inducing agent system of copending patent application Ser. No. 561,347 now U.S. Pat. No. 4,025,350 (assigned to Zirconal Processes Limited) the salt and delaying agent being in the one slurry and the inducing agent in the other.

c. The basic zirconium salt/gellation-delaying agent-/gellation-inducing agent system of the divisional application from application Ser. No. 561,347 filed on Dec. 8, 1976, now U.S. Pat. No. 4,025,350, the salt delaying agent being in one slurry and the inducing agent in the other slurry.

d. A silica aquasol, a silical alcosol or a hydrolysed alkyl silicate and the gellation inducing agent is the magnesia dispersion specified in application Ser. No. 561,245 now U.S. Pat. No. 4,018,858. One slurry contains the silica derivative and the other slurry the magnesia dispersion.

A powdered refractory material is advantageously applied to the mixture of slurries during gelling.

The pattern may be a non-expendable pattern or an expendable pattern. Non-expendable patterns may be made from wood, metal or plastic. Expendable patterns may be wax or a plastic material. Preferably the pattern is coated by spraying the two slurries on to the pattern either consecutively or by means of a spraying apparatus in which the two slurries are mixed just prior to spraying.

The powdered refractory material forms the surface of the mould on to which the molten metal (or allow is cast. To obtain good definition and good surface finish on the material being cast, the refractory material must have a small particle size and must not react with the material being cast. Desirably, the major part of the refractory material should pass a 200 mesh B.S. 410 sieve. Among examples of suitable refractory materials are alumina and the aluminosilicates, zircon, zirconia, fused silica and spinel materials.

The preferred magnesia is a light magnesia. The preparation of dispersions of light magnesia in a mixture of water and polyhydric alcohols is described in British Patent 1,356,247. This Patent also describes the preparation of gellable mixtures of refractory powders dispersed in a silica aquasol or a silica alcosol, with dispersions of light magnesia in water and polyhydric alcohol systems. The preparation of gellable mixtures of dispersions of light magnesia in water and polyhydric alcohol systems with dispersions of refractory powders in aqueous solutions of a zirconium salt is described in copending application Ser. No. 561,347 now U.S. Pat. No. 4,025,350.

Silica aquasols and silica alcosols are well known. For a description of properties and methods of preparation, see R. K. Iler, "The Colloid Chemistry of Silica and Silicates" (Ithaca, N.Y. Cornell University Press, 1955).

As prepared, the silica aquasols are almost always alkaline. Alkaline silica aquasols must be made acid before they are suitable for use in the present process.

The hydrolysed alkyl silicate solution is preferably an acid hydrolysed alkyl silicate solution. Methods for the preparation of acid hydrolysates of alkyl silicates are well known. The term acid hydrolysed alkyl silicate solution includes mixed acid hydrolysates of alkyl silicates and metal salts, which may be prepared as described in British Pat. No. 1,356,248, also acid hydrolysates of organic silicates, particularly ethyl silicate prepared as described in British Specification No. 898,103, and acid hydrolysates of organic silicates (particularly ethyl silicate), prepared using a silica aquasol as described in British Specifications Nos. 768,232 and 1,309,915 together with the acid hydrolysates of ethyl silicate prepared using a silica alcosol. Other methods for the preparation of hydrolysed alkyl silicate solutions are described in U.K. Pat. Specification No. 1,459,786 which also describes the preparation of gellable mixtures of refractory powders dispersed in hydrolysed alkyl silicate solution, with dispersion of light magnesia in water and polyhydric alcohol systems.

When the gellable mixture used to coat the pattern has gelled, a powdered refractory and a binder which is subsequently caused or allowed to harden is applied to the gelled coating to complete the preparation of the mould or core. If the pattern is non-expendable, one suitable powdered refractory and binder is a mixture of silica sand and sodium silicate solution. The silica sand should be slightly dampened with the sodium silicate solution. Carbon dioxide gas may be used for hardening. Other methods of hardening silica sand and sodium silicate systems are known and may be used. Details of these procedures are given in 'Foundry Year Book', 1975, Table 14, P. 209. Silica sands bonded with a synthetic resin may also be used. Methods of hardening these sands are given in 'Foundry Year Book', 1975, Table 14, P. 210. Mixtures of zircon and silica sand may also be used with sodium silicate solution and hardened by carbon dioxide gas. Mixtures of fireclay grog and sodium silicate solution may also be used, being hardened by carbon dioxide gas. Alternatively, the powdered refractory and binder applied to the gelled coating may be as described in British Patent Specification No. 716,394. This powdered refractory and binder may be hardened as described in British Pat. Specification No. 716,394 and the mould or core ignited as described in British Pat. Specification No. 716,394.

If the pattern is an expendable pattern, examples of suitable powdered refractory and binder systems are given in British Pat. Specifications Nos. 768,232 and 650,532. These specifications also give methods for hardening the refractory and binder systems.

The following are examples of combinations of slurries which may be used in the present invention.

SLURRY NO. 1.A 400 grams of refractory powder comprising 90 parts by weight of Molochite (120 grade) and 10 parts by weight of ball clay grade TWVD, supplied by Watts Blake Bearne & Co. Ltd. are dispersed in 210 ml of a solution of one volume of Zetabond 10 and one volume water. The Molochite and the grade numbers refer to British Standard 410 sieves. Flow time through a B-4 cup, B.S. 3900 was 65 seconds. Zetabond 10 is a formulation containing 100 ml of zirconium acetate solution ($ZrO_2$ content 22% w/w) in which are dissolved 10 gm of magnesium acetate $4H_2O$ crystals. The 10 in Zetabond 10 designates the number of grams of magnesium acetate. Thus Zetabond 20 contains 20 gm of magnesium acetate. Molochite is a Registered Trade Mark denoting a china clay calcination product.

SLURRY NO. 1B

To 100 ml of water was added 5.0 grams of light magnesia (grade LMO/262) followed by 150 grams of Molochite (120 grade). Flow time through a B-4 cup, B.S. 3900 was 50 seconds. One volume of Slurry No. 1.A + One volume Slurry No. 1B - set in 30 seconds. Two volumes of Slurry No. 1.A + One volume Slurry No.1.B - set in 45 seconds. In each case strength development was good.

SLURRY NO. 2A

As Slurry No. 1.A

SLURRY NO. 2B

To 100 ml of a mixture of glycerol and water (10 parts by volume of glycols with 90 parts by volume of water) was added 5.0 grams of light magnesia (grade LMO/262) followed by 150 grams of Molochite (120 grade). Flow time through a B-4 cup, B.S. 3900 was 40 seconds.

One volume of Slurry No. 2.A + One volume Slurry No. 2. B - set in 30 seconds. Strength development was satisfactory.

SLURRY NO. 3.A 1.2 kg of Molochite (200 grade) and 1.2 kg of Molochite (30/80 grade) are dispersed in 1.0 litre of Zetabond C.

SLURRY NO. 3.B 1.2 kg of Molochite (200 grade) and 1.2 kg of Molochite (30/80 grade) are dispersed in a mixture of 500 ml water and 500 ml pure triethanolamine.

One volume of slurry No. 3.A + One volume Slurry No. 3.B - set in 15 seconds.

SLURRY NO. 4.A 200 grams of refractory powder comprising 90 parts by weight of Molochite (120 grade) and 10 parts by weight of ball clay grade TWVD are dispersed in 105 ml of Zetabond C.

SLURRY NO. 4.B 200 grams of Molochite (120 grade) are dispersed in a mixture of 50 ml water and 50 ml technical grade triethanolamine. The composition of the technical grade triethanolamine used was (percentages are by weight)

Triethanolamine — 80% min
Diethanolamine — 15% max
Monoethanolamine — 4% max
Water — to 100%

1 volume of Slurry No. 4.A + 1 volume Slurry No. 4.B - viscous in 15 seconds, set in 60 seconds.
2 volumes of Slurry No. 4.A + 3 volumes Slurry No. 4.B - viscous in 30 seconds, set in 55 seconds.
2 volumes of Slurry No. 4.A + 1 volume Slurry No. 4.B - set in 5 seconds.

Optionally, when the first slurry is a dispersion of a refractory powder in a solution of a zirconium salt containing at least one of the gel-controlling additives described in British Pat. Application No. 35610/74, it may be used with a solution of a gel-inducing agent described in British Pat. Application No. 35610/74. The following are examples of this procedure, to be used in the first step of the present invention. British Pat. Application No. 35610/74 is the equivalent of U.S. Application No. 561,347 now Pat. No. 4,025,350.

PREPARATION OF SLURRY 200 grams of refractory powder comprising 90 parts by weight of Molochite (120 grade) and 10 parts by weight of ball clay (grade TWVD) are dispersed in 105 ml of Zetabond 20.

SOLUTION OF GEL-INDUCING AGENT

SOLUTION NO. 1

Water 75% v/v : Techanical grade triethanolamine 25% v/v

SOLUTION NO. 2

Water 50% v/v : Technical grade triethanolamine 50% v/v 2 volumes of slurry + 1 volume Solution No.1 - set in 20 secs.
1 volume of slurry + 1 volume Solution No.1 - set in 15 secs.
2 volumes of slurry + 3 volumes Solution No.1 - set in 15 secs.
2 volumes of slurry + 1 volume Solution No.2 - set in 20 secs. The composition of the technical grade of triethanolamine used is given in Slurry No. 4. B.

The invention will not be described by way of example and with reference to the accompanying schematic drawing wherein:

FIG. 1 shows a mould-making procedure.

EXAMPLE 1

This example illustrates a procedure for spraying a mixed slurry. The slurries which make up the mixture are as follows:

SLURRY NO. 1

Zetabond 10 is mixed with Molochite (120 grade) to form a relatively mobile slurry of the general consistency of commercially sold emulsion paint.

Such a mobile slurry can be made by mixing weight for weight Zetabond 10 and Molochite (120 grade). To this mixture is further added a suitable suspension aid. There are several possible materials. One suitable material has between 5% and 10% of ball clay which has a similar chemical composition to that of Molochite.

SLURRY NO. 2

Consists of water with a similar weight of Molochite (120 grade) with a percentage of suitable magnesium oxide (gellation inducing agent) which will result in a gel time suitable for the job. In the method now described, it is desirable to provide a gel time for approximately 30 - 40 seconds, from the moment that the two slurries meet each other and are mixed. In order to obtain this type of gel time, without adverse effect on the refractory properties subsequently, a grade of light magnesia is used in excess of 0.01%, and less than 1% by weight of the refractory material used. It should be noted that each of these two slurries with occasional stirring will maintain a stable condition in an enclosed space, such as a sealed drum more or less indefinitely. It should also be noted that if these two slurries are added together in approximately equal proportions they will set to a hard gel in approximately 40 seconds.

Apparatus for conducing the spraying operation is illustrated in FIG. 1.

The spraying head 1 schematically indicated comprises separate pipe lines 2 and 3 each connected to a pressurised pot containing a mixing motor (not shown). Each pot and motor is of the type used in the paint industry and is pressurised to approximately 40 p.s.i. The pipes 2 and 3 diverge and each terminate in an inwardly inclined nozzle 4. Thus in use the two slurry steams 5, one containing Slurry 1 and the other containing Slurry 2, from the nozzle 4 converge and mix immediately above a pattern 6 being coated. The pattern 6 is contained on a base 7 between walls 8.

An apparatus is thus provided together with two reactive slurries capable of being sprayed, having in admixture a fast setting time. This being the case, if a pattern suitable for precision casting is taken and treated with a suitable parting agent for Zetabond compositions, the pattern may be sprayed with the combined slurries to form a thin film 9 of refractory slurry in which a high degree of control of overall thickness can be obtained, depending upon the length of time the spray gun is in operation. By way of example, a layer of approximately 1/16 - ⅛ inch thick can be evenly coated all over the pattern. It should be noted that because the material will gel in approximately 40 seconds, there will be little or no tendency for the slurry to run off the high spots and flow into the low spots and create uneven thickness. However, immediately after spraying a coating of $CO_2$ sand (foundry sand and sodium silicate) is preferably applied.

When the $CO_2$ sand has been hardened, the pattern can be stripped from the mould, and one of several procedures may now be followed prior to the casting of the metal. By way of example, one might heat with a powerful torch flame the face of the mould to dry out the water, and also to create crazing (provided that suitable refractory material has been used, being selected to allow micro-crazing without gross cracking under these circumstances, also to withstand thermal shock). If dimensional tolerances were not particularly important, the mould could be dried carefully in a warm oven for a period of some hours in order to drive out the residual water. The preferred method described here would be to use a high velocity combustion system designed to provide a copious supply of gaseous combustion products at approximately 300° C, and induce rapid evaporation from the surface of the gelled slurry in order (a) to drive out the water, and (b) to induce the desirable micro-crazed cracking. The mould could then be dried to 100° C as is common practice, but the preferred method is to do the whole operation in a conventional foundry sand box or a mechanised sand box in order to enhance the strength of the mould, and to ensure that the evaporation of the liquids in the gelled slurry is carried on for long enough to ensure that no residual water remains in the mould prior to casting metal.

The methods described above can be used to spray other slurry mixtures. The use of silica sols or ethyl silicates, or sodium or potassium silicate is envisaged.

EXAMPLE 2

Preparation of Mould Dressing for the technique set out above.

A mould dressing is prepared as follows:

STAGE 1

Zetabond 10 is diluted with isopropanol in the proportion of two volumes Zetabond 10 to one volume of isopropanol.

STAGE 2

Graphite powder is added to the liquid prepared in Stage 1, in the proportion of 40% v/v. The graphite powder desirably contains magnesium oxide to cause the composition to set. Sardamag DP52 is suitable; up to 2% by weight, based on the weight of graphite, may be used. The composition is preferably applied by spraying, but may also be applied by brushing.

We claim:

1. A method of preparing a mould or core for casting liquids such as molten metals, such method comprising the steps of coating a pattern with a mixture of two slurries each of which is substantially stable but which together gell to form a rigid coherent shape wherein each slurry is discharged as a stream onto the pattern, the two streams converging adjacent the pattern to mix the slurries.

2. A method as claimed in claim 1 wherein each stream is discharged from a jet nozzle communicating with a reservoir of the corresponding slurry.

3. A method as claimed in claim 1 wherein one slurry contains powdered refractory material and a binder, and the other slurry contains powdered refractory material and a gellation-inducing agent for the binder.

4. A method as claimed in claim 3 wherein the said one slurry also contains a gellation-delaying agent.

5. A method as claimed in claim 3 wherein the binder is an aqueous solution of a zirconium salt and the inducing agent is a dispersion of calcined magnesia powder in a mixture of water and a polyhydric alcohol.

6. A method as claimed in claim 3 wherein the binder is an aqueous solution of a zirconium salt which when dissolved in water yields an aqueous solution that is acidic, the gellation-inducing agent is selected from the group consisting of aminoalcohols, morpholine, dead burned magnesia powder and powdered magnesia containing spinels and the slurry containing the binder also includes a gellation-delaying agent selected from the group consisting of magnesium acetate, magnesium lactate, ammonium lactate, glycine, betaine, fructose and polyhydric alcohols.

7. A method as claimed in claim 3 wherein the binder is an aqueous solution of a zirconium salt which when dissolved in water yields an aqueous solution that is alkaline, the gelation inducing agent is selected from the group consisting of dead burned magnesia powder and powdered magnesia-containing spinel and the slurry containing the binder also includes a gellation-delaying agent selected from the group consisting of magnesium acetate, magnesium lactate, ammonium lactate, glycine, betaine, fructose and a polyhydric alcohol.

8. A method as claimed in claim 3 wherein the binder is a silica aquasol, a silica alcosol or a hydrolysed alkyl silicate solution and the gellation inducing agent is a dispersion of calcined magnesia in a mixture of water and a polyhydric alcohol.

9. A mixture as claimed in claim 1 wherein the slurry mixture on the pattern is coated with refractory grains.

10. A method as claimed in claim 9 wherein the grains are of silica sand damped with sodium silicate and the slurry is thereafter caused to harden.

11. A method as claimed in claim 8 wherein the hardening is caused by contacting the surface of the coated pattern with $CO_2$ gas.

* * * * *